US008336616B1

(12) United States Patent
McClinton

(10) Patent No.: US 8,336,616 B1
(45) Date of Patent: Dec. 25, 2012

(54) FRAC PLUG

(75) Inventor: Tony D. McClinton, Odessa, TX (US)

(73) Assignee: McClinton Energy Group, LLC, Odessa, TX (US)

( * ) Notice: Subject to any disclaimer, the term of this patent is extended or adjusted under 35 U.S.C. 154(b) by 365 days.

(21) Appl. No.: 12/782,754

(22) Filed: May 19, 2010

(51) Int. Cl.
*E21B 33/129* (2006.01)
*E21B 33/134* (2006.01)

(52) U.S. Cl. ..... 166/135; 166/179

(58) Field of Classification Search ..... 166/179, 166/118, 135, 196
See application file for complete search history.

(56) References Cited

U.S. PATENT DOCUMENTS

| | | | | |
|---|---|---|---|---|
| 2,204,648 | A * | 6/1940 | Baker | 166/134 |
| 6,220,349 | B1 | 4/2001 | Vargus et al. | |
| 6,491,108 | B1 | 12/2002 | Slup et al. | |
| 6,581,681 | B1 | 6/2003 | Zimmerman et al. | |
| 6,796,376 | B2 | 9/2004 | Frazier | |
| 7,789,137 | B2 * | 9/2010 | Turley et al. | 166/138 |
| 2007/0187085 | A1 * | 8/2007 | Dewey et al. | 166/55 |
| 2011/0240295 | A1 * | 10/2011 | Porter et al. | 166/308.1 |

* cited by examiner

*Primary Examiner* — Brad Harcourt
(74) *Attorney, Agent, or Firm* — Buskop Law Group, PC; Wendy Buskop

(57) ABSTRACT

At least one frac plug for use in a wellbore are disclosed herein. The frac plug can include a mandrel having a first end and a second end, a nose connected to the second end of the mandrel, and a crown disposed on the first end of the mandrel.

14 Claims, 5 Drawing Sheets

FRAC PLUG

FIELD

The present embodiments generally relate to frac plugs that can be used in wellbores.

BACKGROUND

A need exists for a frac plug that can be utilized within oil wellbores or gas wellbores.

A need exists for a composite frac plug that can withstand high temperatures, which can be easily located and set within a wellbore.

The present embodiments meet these needs.

BRIEF DESCRIPTION OF THE DRAWINGS

The detailed description will be better understood in conjunction with the accompanying drawings as follows.

Figure 1:
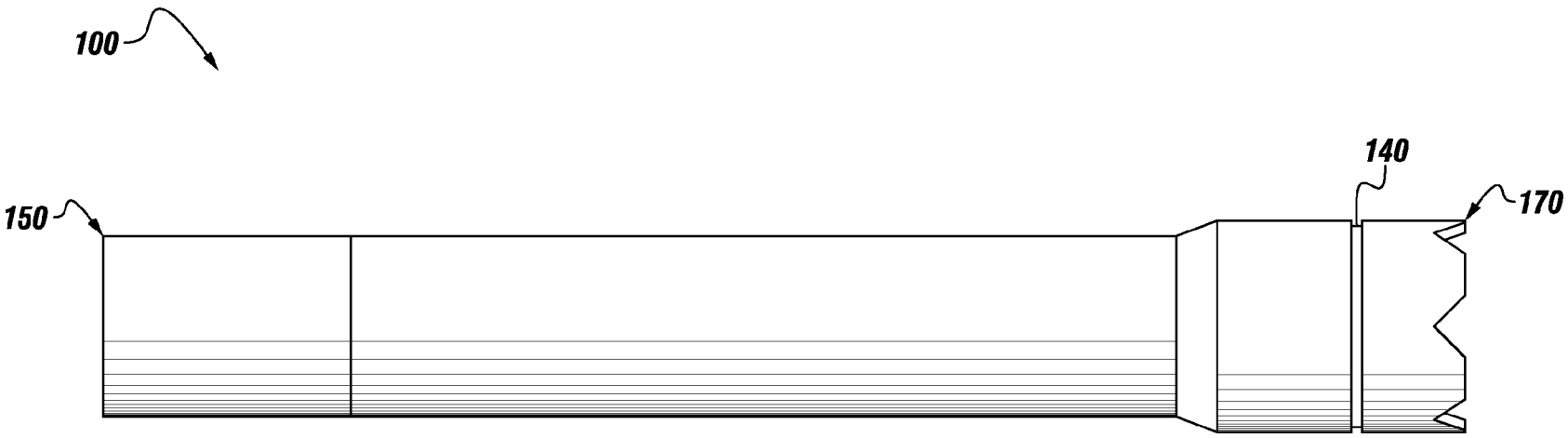
FIG. 1 is a mandrel according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a frac plug for use in downhole operations. The downhole operations can include drilling, production, injection, or workover operations.

The frac plug can include a mandrel having a crown on one end and a nose at the other end. For example, the crown can be formed on or connected to an upper or first end of the mandrel, and the nose can be connected to or formed on a lower or second end of the mandrel. In one or more embodiments, a portion or all of the mandrel can be made from a nonmetallic material, such as a composite.

The nose can have a slot at least partially formed through a portion thereof. The slot can drain water. The slot can run parallel to the mandrel.

An end of the nose can be tapered. Accordingly, the nose can be configured to engage a crown of a lower frac plug and rotate the lower frac plug during drill out operations. The crown can have one or more pitches or grooves formed therein. The pitches or grooves can lock with an upper nose of a frac plug.

The frac plug can also include two slips disposed about the mandrel between the crown and the nose. The slips can be any device used downhole to set one or more plugs or packers within a wellbore. The slips can be cast iron, non-metallic, or combinations thereof. The slips can have one or more grooves formed into an inner diameter thereof. The groves can be in a checker board pattern and can be from about 1/16 of an inch to about 1/32 of an inch.

The frac plug can also include a seal disposed between the slips. The seal can be an elastomeric seal or similar seal. The seal can be configured to withstand the environment of the wellbore. For example, the seal can be configured to withstand contact with sour gas and high temperatures. The seal can be a single segment seal or can include a plurality of segments.

The frac plug can also include a shear device connected to the mandrel. The shear device can be metallic or composite. In addition, the shear device can be threaded or pinned. In one or more embodiments, the shear device can thread or connect to the end of the mandrel adjacent the nose. The shear device can have left handed threads.

In one or more embodiments, the frac plug can also include a pump down ring disposed on at least a portion of the nose. The pump down ring can be configured to flexibly pass through the inner casing or production tubing. The pump down ring can be configured to form a flow area between the casing or production tubing inner diameter and the outer diameter of the pump down ring that is smaller than an area between another portion of the frac plug and the inner diameter of the production tubing or casing. As such, the pump down ring can reduce the fluid needed to pump the frac plug to a portion of a wellbore and also reduces the fluid that is pumped into the formation.

In one or embodiments, an upper or first slip back up can be disposed about the mandrel adjacent to the upper or first slip, which can be disposed about the mandrel adjacent the crown. In addition, a lower or second slip back up can be disposed adjacent the lower or second slip, which can be adjacent the nose. The slip back ups can be one or more rings that serve to evenly distribute or at least substantially evenly distribute axial forces asserted on the seal disposed between the slips.

An upper or first non-extrusion ring can be disposed about the mandrel adjacent the first slip back up, and a lower or second non-extrusion ring can be disposed about the mandrel adjacent the second slip back up. The seal can be disposed between the non-extrusion rings. Accordingly, the non-extrusion rings can support the seal at both sides. In one or more embodiments, the non-extrusion rings can be an elastomeric element.

The frac plug can also have a ring disposed about the mandrel adjacent to the crown. The ring can be a load ring that is made from rubber, elastomeric material, or similar materials. The ring can have a wall thickness of about 1/4 of an inch to about 2 inches. The ring can provide support to the mandrel and increase the pressure that the mandrel can withstand, for example the ring can enable the upper or first portion of the mandrel to withstand about 12,000 pounds of pressure.

In one or more embodiments, an anti-rotation ring can be disposed about the mandrel adjacent the crown. The anti-rotation ring can be a stiff or non-compressible o-ring. The anti-rotation ring can engage an inner surface of a setting sleeve. The anti-rotation ring can reduce rotation between the mandrel and the setting sleeve.

In one or more embodiments, a ball seat can be formed into an inner diameter of the second end of the mandrel. The ball seat can be configured to receive a ball that is sent downhole after the frac plug is properly positioned. In one or more embodiments of the frac plug, the shear device can be solid to create a bridge plug. The shear device can have a hole formed through it providing a ball drop frac plug.

Turning now to the Figures, FIG. 1 depicts a mandrel according to one or more embodiments. The mandrel 100 can have a first end 170 and a second end 150. A crown, which is not shown in this Figure, can be disposed on the first end 170. The second end 150 can also be configured to engage a nose, which is also not shown in this Figure.

The mandrel 100 can also have an anti-rotation ring groove 140 formed into the first end 170. The anti-rotation ring groove 140 can be adjacent and can secure an anti-rotation ring, not shown in this Figure, about the mandrel 100.

Figure 2:
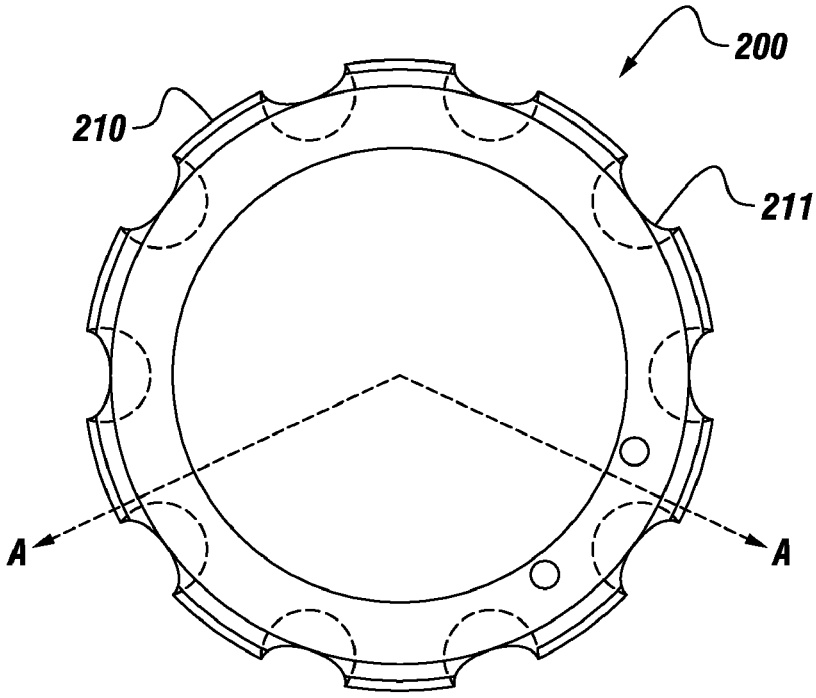
FIG. 2 depicts a top view of a slip according to one or more embodiments.

FIG. 2 depicts a top view of a slip according to one or more embodiments. The slip 200 can have an outer diameter having one or more sets of ridges or teeth 210. The one or more sets of ridges or teeth 210 can be configured to engage an inner diameter of a casing or production tubing when the frac plug is set. One or more scallops 211 can be formed into the outer diameter of the slip 200.

Figure 3:
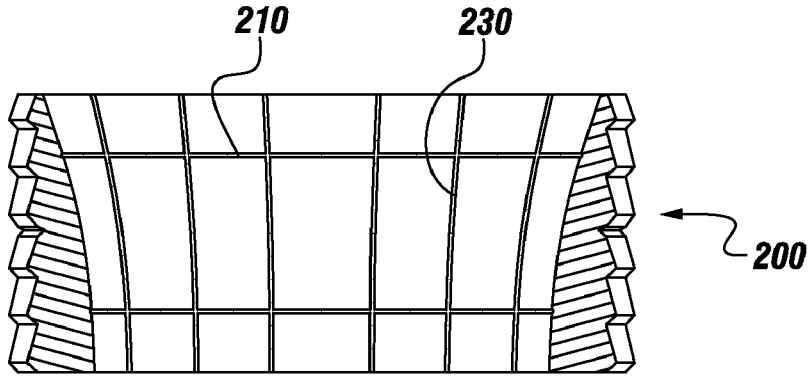
FIG. 3 depicts a cut view of the slip of FIG. 2 along line A-A according to one or more embodiments.

FIG. 3 depicts a cut view of the slip of FIG. 2 along line A-A according to one or more embodiments. The slip 200 can also have an inner diameter having one or more scores or grooves 210, 230 formed into it. The scores or grooves 210, 230 can be in a checker board pattern having one or more horizontal scores or grooves 210 and one or more vertical scores or grooves 230.

Figure 4:
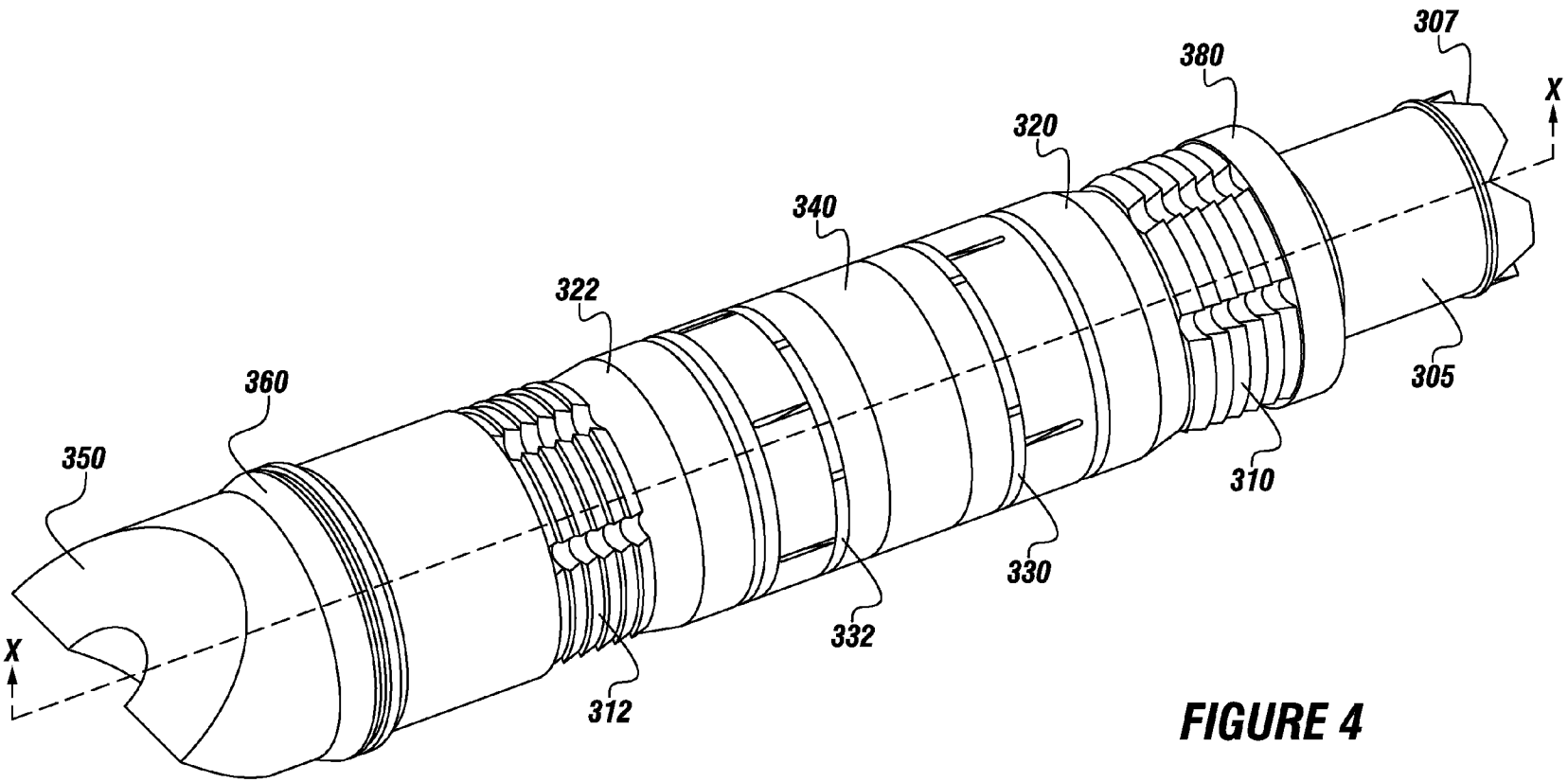
FIG. 4 depicts an isometric view of an illustrative frac plug according to one or more embodiments.

FIG. 4 depicts an isometric view of a frac plug according to one or more embodiments. The frac plug can include a mandrel 305 having the crown 307, a load ring 380, one or more slips, in which two are shown 310, 312, one or more slip back ups, in which two are shown 320, 322, one or more anti-extrusion rings, in which two are shown 330, 332, one or more seals 340, a nose 350, and one or more pump down rings 360.

The mandrel 305 can have the crown 307 on an upper or first end, and the nose 350 can be disposed about or connected to the mandrel 305 at a lower or second end. The mandrel 305 can be similar to the mandrel 100 as shown in FIG. 1 or another mandrel used in downhole operations.

The load ring 380 can be disposed about the mandrel 305 adjacent or proximate to the crown 307. The load ring 380 can reinforce a portion of the mandrel 305 to enable the mandrel 305 to withstand high pressures.

An upper or first slip 310 can be adjacent the load ring 380, and a lower or second slip 312 can be adjacent the nose 350. The slips 310, 312 can be similar to the slips depicted in FIGS. 2 and 3, or the slips 310, 312 can be bidirectional slips, unidirectional slips, or any other slips that are used in downhole operations.

An upper or a first slip back up 320 can be adjacent to the first slip 310. At least a portion of the first slip back up 320 can be tapered to at least partially rest within the first slip 310. A lower or second slip back up 322 can be adjacent the second slip 312. At least a portion of the second slip back up 322 can be tapered to at least partially rest within the second slip 312.

An upper or first anti-extrusion ring 330 can be disposed about the mandrel 305 adjacent the first slip back up 320. The first anti-extrusion ring 330 can be disposed between the first slip back up 320 and the seal 340. A lower or second anti-extrusion ring 332 can be disposed about the mandrel 305 adjacent the second slip back up 322. The lower anti-extrusion ring 332 can be disposed between the seal 340 and the second slip back up 322.

The seal 340 can be disposed between the anti-extrusion rings 330 and 332. The seal 340 is depicted having three segments, but the seal 340 can include one or more segments.

The pump down ring 360 can be disposed about the nose 350. For example, the pump down ring 360 can be placed within a groove formed into the nose 350. The nose 350 can thread or otherwise connect to the lower or second end of the mandrel 305.

Figure 5:
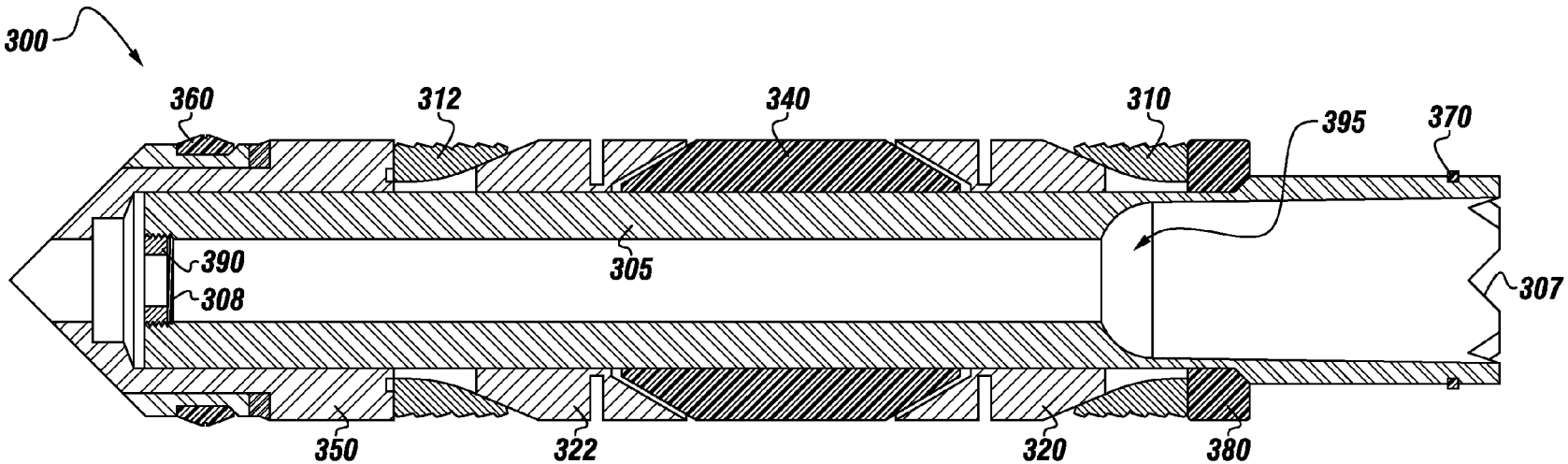
FIG. 5 depicts a cut view of the frac plug of FIG. 4 along line X-X.

FIG. 5 depicts a cut view of the frac plug of FIG. 4 along line X-X. The frac plug 300 can include a ball seat 395 formed into the mandrel 305 adjacent the crown 307, a threaded recess 308 formed into the lower or second end of the mandrel 305, and a shear device 390 disposed within the threaded recess 308.

The ball seat 395 can receive a ball, which is not shown. The ball seat 395 can isolate the wellbore once the ball is in place.

The threaded recess 308 can have one or more left handed threads for securing or connecting the shear device 390 to the mandrel 305.

An anti-rotation ring 370 can secure the anti-rotation ring groove, which was depicted in FIG. 1.

The other parts depicted in FIG. 5 include the pump down rings 360, the nose 350, the slips 310, 312, one or more slip back ups 320, 322, a seal 340, and a load ring 380.

Figure 6:
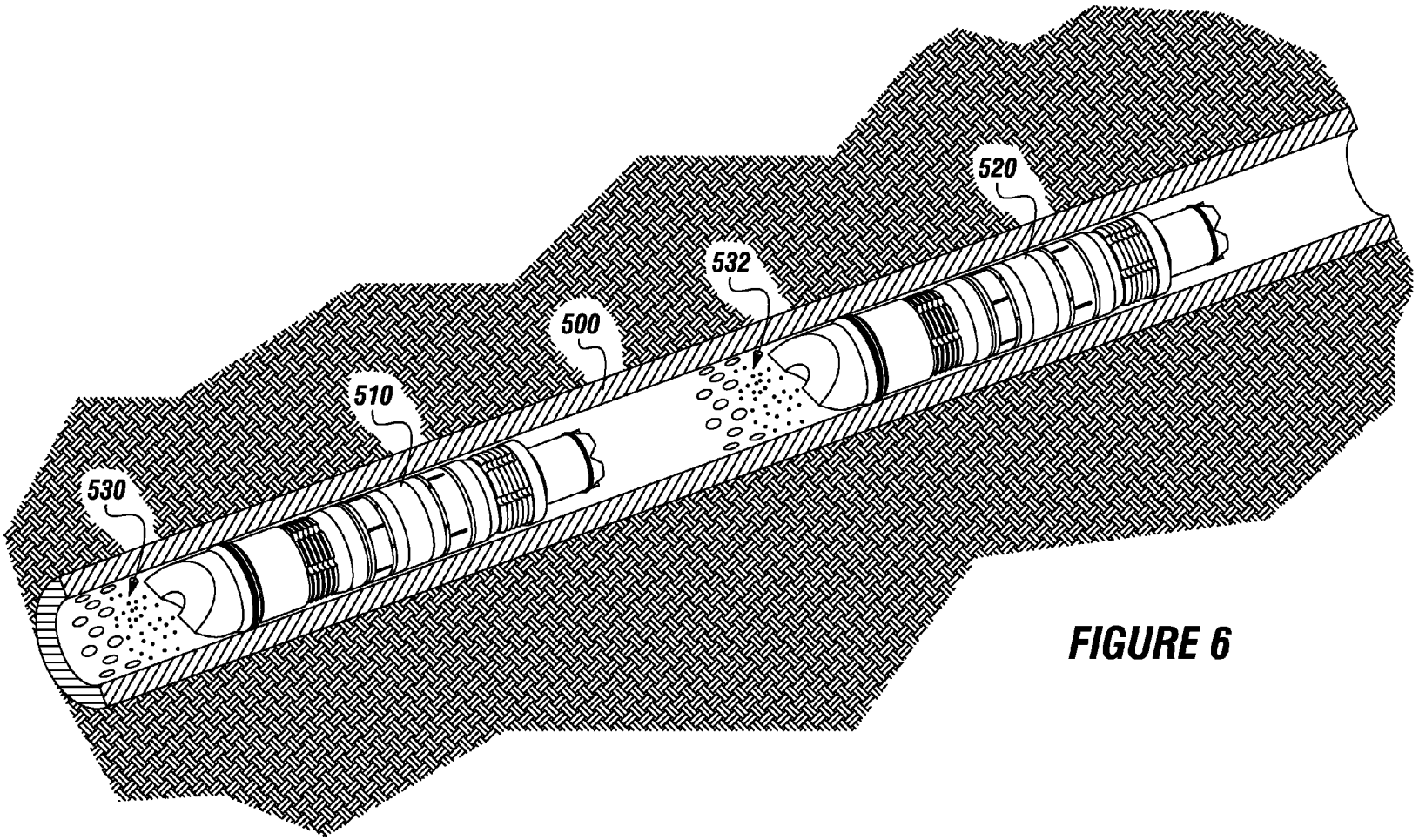
FIG. 6 depicts a schematic view of two frac plugs disposed within a wellbore according to one or more embodiments.

FIG. 6 depicts a schematic view of two frac plugs disposed within a wellbore. The operation of the embodied frac plugs can be understood in great detail with reference to FIGS. 3, 4, and 6.

The wellbore 500 can be a deviated, horizontal, or vertical wellbore. The wellbore 500 can be an open hole wellbore or can have production tubing disposed therein. As depicted, the wellbore 500 has a perforated casing and two hydrocarbon bearing zones 530, 532. The embodiments of the frac plug described herein can be used within casing or within production tubing.

In operation, coil tubing, wire lines, or other devices, which are not shown, can be used to place the frac plugs 510, 520 in the wellbore 500. The frac plugs 510, 520 can isolate the hydrocarbon bearing zones 530, 532 from one another. The frac plugs 510, 520 can be similar to the frac plug 300, as shown in FIG. 5. The operation of the frac plugs 510, 520 will be described with reference to FIGS. 3 and 4 for convenience. However, one or more embodiments of the frac plugs 510, 520 can have more or fewer parts than depicted on FIGS. 3 and 4.

Upon placement of the lower frac plug 510 in the wellbore 500, the upper slip 310 and slip back up 320 can be moved down to expand the seal 340.

At the same time, the slips 310, 312 can slide about the slip back ups 320, 322. The slips 310, 312 can be forced outwards to engage the inner diameter of the casing or wellbore 500. The upper frac plug 520 can be placed and set in the wellbore 500 in a manner substantially similar to the lower frac plug 510.

The frac plugs 510, 520 can be removed from the wellbore by drilling or milling out. As the upper frac plug 520 is drilled out the nose 350, a portion of the upper frac plug 520, or combinations thereof can fall from the upper frac plug 520 and rest on the crown 307 of the lower frac plug 510.

The lower frac plug 510 can then be drilled or machined out and the nose 350 of the upper frac plug 520 can remain static relative to the crown 307.

While these embodiments have been described with emphasis on the embodiments, it should be understood that within the scope of the appended claims, the embodiments might be practiced other than as specifically described herein.

What is claimed is:

1. A frac plug for use in a wellbore comprising:

a. a mandrel having a crown, wherein the crown has v-shaped notches formed therein, and an anti-rotation ring groove formed adjacent to the crown;

b. a load ring disposed about the mandrel;

c. a nose cone connected with the mandrel, wherein the nose cone has a pair of opposing surfaces, wherein the pair of opposing surfaces are beveled to a point; and d. at least one slip, at least one slip back up, and at least one seal disposed about the mandrel between the load ring and the nose cone.

2. The frac plug of claim 1, further comprising a shear device disposed within the mandrel.

3. The frac plug of claim 1, wherein the mandrel has a body portion adjacent the crown that has a first diameter and another body portion with a second diameter.

4. The frac plug of claim 3, wherein a shoulder is formed between the body portions.

5. The frac plug of claim 4, wherein the load ring abuts the shoulder.

6. The frac plug of claim 1, further comprising a pump down ring disposed about the nose cone.

7. The frac plug of claim 1, further comprising a ball seat formed within the mandrel.

8. A down hole system comprising at least an upper frac plug and a lower frac plug, wherein the upper frac plug and the lower frac plug comprise:

a. a mandrel having a crown, wherein the crown has v-shaped notches formed therein, and an anti-rotation ring groove formed adjacent to the crown;

b. a load ring disposed about the mandrel;

c. a nose cone connected with the mandrel, wherein the nose cone has a pair of opposing surfaces, wherein the pair of opposing surfaces are beveled to a point; and d. at least one slip, at least one slip back up, and at least one seal disposed about the mandrel between the load ring and the nose cone, wherein the nose cone of the upper frac plug is configured to engage at least two v-shaped notches formed in the crown of the lower frac plug during drill out operations.

9. The frac plug of claim 8, further comprising a shear device disposed within the mandrel.

10. The frac plug of claim 8, wherein the mandrel has a body portion adjacent the crown that has a first diameter and another body portion with a second diameter.

11. The frac plug of claim 10, wherein a shoulder is formed between the body portions.

12. The frac plug of claim 11, wherein the load ring abuts the shoulder.

13. The frac plug of claim 8, further comprising a pump down ring disposed about the nose cone of at least one of the frac plugs.

14. The frac plug of claim 8, further comprising a ball seat formed within the mandrel.

* * * * *